US007076182B2

(12) United States Patent
Osawa et al.

(10) Patent No.: US 7,076,182 B2
(45) Date of Patent: Jul. 11, 2006

(54) DEVELOPING APPARATUS

(75) Inventors: Keishi Osawa, Yokohama (JP); Satoshi Tomiki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 392 days.

(21) Appl. No.: 10/073,395

(22) Filed: Feb. 12, 2002

(65) Prior Publication Data

US 2003/0081960 A1 May 1, 2003

(30) Foreign Application Priority Data

Feb. 16, 2001 (JP) ..... 2001-040708

(51) Int. Cl.
*G03G 15/06* (2006.01)

(52) U.S. Cl. ..... 399/55

(58) Field of Classification Search ..... 399/53, 399/55, 98, 234, 235, 270, 285; 347/140
See application file for complete search history.

(56) References Cited

U.S. PATENT DOCUMENTS 5,270,783 A * 12/1993 Bisaiji et al. ..... 399/235 X
5,671,470 A * 9/1997 Maruta et al. ..... 399/235
6,226,481 B1 * 5/2001 Yoneda et al. ..... 399/53 X
6,282,385 B1 * 8/2001 Suto ..... 399/55

FOREIGN PATENT DOCUMENTS

JP 10-073985 * 3/1998

* cited by examiner

*Primary Examiner*—Sandra Brase
(74) *Attorney, Agent, or Firm*—Fitzpatrick, Cella, Harper & Scinto

(57) ABSTRACT

A developing apparatus includes a toner carrying member for carrying toner to a developing zone where the developing apparatus faces to an image bearing member; bias voltage applying means for applying to the toner carrying member a developing bias voltage for developing an electrostatic latent image formed on the image bearing member, wherein the developing bias voltage is in the form of a DC voltage biased with an AC voltage; wherein when a developing operation stops, rotation of the toner carrying member is stopped while rotating the image bearing member electrically charged, and then, the AC voltage is applied to the toner carrying member for a predetermined period, and thereafter, the AC voltage is stopped in a condition in which regular-charge toner is being urged from the toner carrying member toward the image bearing member.

11 Claims, 8 Drawing Sheets

DEVELOPING APPARATUS

FIELD OF THE INVENTION AND RELATED ART

The present invention relates to a developing device for developing an electrostatic latent image formed on and image bearing member, more particularly to a developing apparatus usable with a copying machine, a printer, a facsimile machine or the like.

A conventional image forming apparatus of this kind includes a copying machine, a printer and so on. Referring first to FIG. 17, a conventional image forming apparatus and an image forming process will be prescribed. FIG. 17 is a schematic illustration of an image formation process portion of a conventional image forming apparatus.

An image bearing member in the form of an electrophotographic photosensitive member (rotatable drum) 50 is rotated in the direction indicated by an arrow X, and is uniformly charged by charging means 54. The surface of the photosensitive drum 50 is exposed to image light 55 so that latent image is formed thereon. Using a developing device 56, a developer (toner) is electrostatically deposited onto the electrostatic latent image by which the latent image on the photosensitive drum 50 is developed into a toner image.

Thereafter, the toner image is transferred onto a recording material (sheet) fed in synchronism with the toner image formation, by a transferring means in the form of a transfer charger 52 which is supplied with a bias voltage having a polarity opposed to that of the toner.

The transferring means may be a contact type transferring means represented by a transfer roller in place of the transfer charger 52. The contact transferring means is advantageous in that amount of production of electric discharge product, such as ozone, is smaller as compared with the charger.

As for the developing system, there are a regular developing system in which the background portion of the image information on the surface of the photosensitive drum 50 uniformly charged, is exposed to light, and the toner is deposited to the portion other than the exposed portion; and a reverse development type in which the portion of surface of the photosensitive drum 50 corresponding to the image information is exposed to light, and the toner is deposited on the exposed portion.

In such a conventional image forming apparatus, there there are provided guiding members (upper guiding member 53*a* which is a first guiding member and lower guiding member 53*b* which is a second guiding member) for guiding the upper surface and the lower surface of the recording material 51 so as to assuredly introduce the recording material 51 to the transfer station where the toner image is transferred onto the recording material.

Adjacent the upper guiding member 53*a* and the lower guiding member 53*b*, the image transfer bias voltage is applied by the transfer charger 52. Therefore, if the recording material 51 becomes wet under a high humidity ambience condition with results of decrease of the existence, there is a possibility that image transfer bias voltage leaks to the upper guiding member 53*a* and the lower guiding member 53*b* through the recording material 51. In order to avoid such a problem, the upper guiding member 53*a* and the lower guiding member 53*b* are made of insulating members.

In this manner, partial void of image transfer due to insufficient electric charge, or the like problem are avoided.

However, since the upper guiding member 53*a* and the lower guiding member 53*b* are made of the insulating members, they tended to be electrically charged to the same polarity as the image transfer bias voltage applied to the adjacent transfer charger 52, that is, the polarity opposite from that of the toner.

The upper guiding member 53*a* and the lower guiding member 53*b* are disposed close to the transfer charger 52, and therefore, are also close to the photosensitive drum 50 in order to assuredly introduce the recording material 51 to the image transfer station, more particularly, they are as close as approx. 1–3 mm from the surface of the photosensitive drum 50.

Accordingly, they are easily charged to the polarity opposite from that of the toner. In addition, the toner floating within the apparatus, particularly the toner of the toner image on the surface of the photosensitive drum 50 at the position immediately before the image transfer position, are electrostatically attracted and deposited on the upper guiding member 53*a* and the lower guiding member 53*b*.

The tendency of the toner deposition is strongest at the leading end portion 53*s* of the upper guide 53*a*, which portions is closest to the surface of the photosensitive drum 50. As a result, there arises a liability that contamination toner is deposited onto the recording material 51, which leads to deterioration of the image quality.

In a type which is represented by the reverse development type, in which the toner image is deposited on the portions at which the potential has attenuated due to exposure, the depositing force of the toner to the photosensitive drum 50 is relatively weak, and the tendency of the toner being attracted to the upper guiding member 53*a* is stronger.

In addition, the toner particles which has scattered may be deposited on the lower guiding member 53*b*.

It is known that in order to solve such a problem, the upper guiding member 53*a* and the lower guiding member 53*b* are made of electroconductive members which are supplied with a bias voltage having a polarity opposite to that of the image transfer bias voltage (the same polarity as the toner) to prevent the toner deposition thereon.

In such a case, there occurs a tendency that image transfer bias voltage (the opposite polarity from the toner) to leak, and therefore, the transfer void is relatively remarkable due to the shortage of the charge to be retained by the recording material 51 or due to the decrease of the resistance due to the moisture absorption of the recording material 51. To avoid this problem, the inner surfaces of the upper and lower guides which are contactable to the recording material 51 is coated with insulation sheets so as to prevent the leakage of the transferring current.

However, such a prior art structure involves the following problems.

As described in the foregoing, by applying the voltage of the same polarity as the toner to the guiding member, the toner scattered from the toner carrying member (developing sleeve) provided in the developing device and/or the regular-charge toner (the toner having the regular polarity charge) in the developed image on the photosensitive drum, are prevented from depositing.

However, under the low humidity ambient condition, particularly when the toner particularly property is deteriorated due to the long term operation of the developing device, the amount of the toner having the charge of polarity opposite from the polarity of the charge of the regular toner.

The toner having the opposite polarity charge is called reversely charged toner, which produces background fog or shadowing which is unintended deposition of the toner around a line letter.

Since the reversely charged toner has the same polarity as the transferring potential, it is not easily transferred onto the recording material 51. However, as described in the foregoing, since the potential applied to the dining members (having the same polarity as the regular toner) and the reversely charged toner, have the opposite polarities, the reversely charged toner are relatively easily deposited on the guiding members. The contamination toner deposited on the guiding members, are deposited in turn onto the recording material 51 with the result of contamination and/or image quality deterioration.

In addition, when the developing device is operated with a low print ratio under an extremely low humidity condition such as 23° C., 5% in durability test, the deterioration of the toner is promoted even to such an extent that amount of the reversely charged toner increases, and the reversely charged toner deposited on the free end of the upper guide from the photosensitive drum, during the post-rotation; the contamination occurs at the leading and training edges of the recording material at each of the image forming operations. The problem is not only with the transfer guide, but a member disposed to close to the drum is contaminated due to the airflow caused by rotation of the drum. The increase of the amount of the reversely charged toner results in increased amount of the untransferred toner. The toner on a toner receptor sheet disposed upstream of the cleaning blade may fall therefrom onto the recording sheet, thus again contaminate the recording material.

SUMMARY OF THE INVENTION

Accordingly, it is a principal object of the present invention to provide a developing device in which the contamination by the reversely charged toner is effectively prevented.

It is another object of the present invention to provide a developing device in which the deterioration of the image quality attributable to the reversely charged toner can be prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiment of the present invention will be described. In the following descriptions, the dimensions, materials, configurations, relative position on relationships of elements constituting the apparatus of this invention are not limiting the present invention, except for particular mentioning to the effect.

First Embodiment

Referring to FIGS. 1 through 13, an image forming apparatus according to the first embodiment of the present invention will be described.

Figure 1:
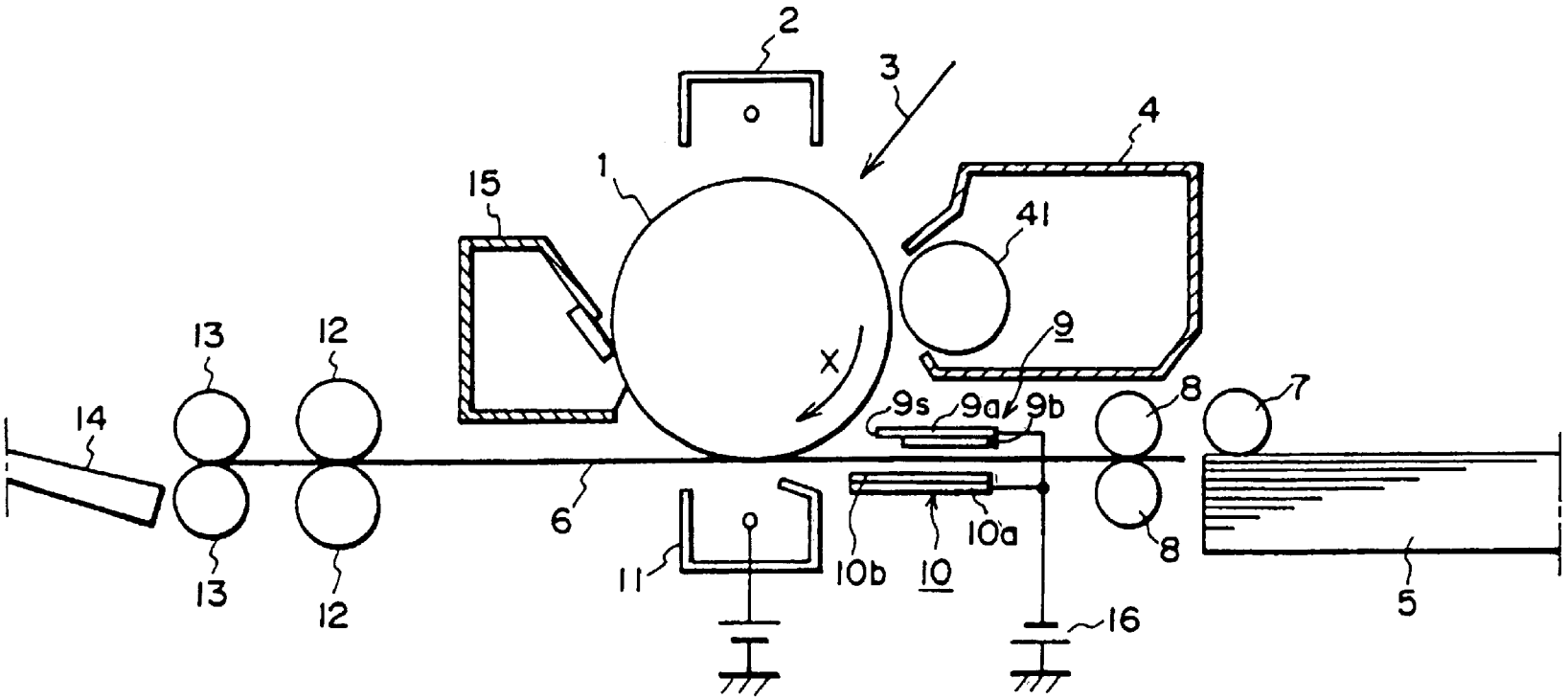
FIG. 1 is a schematic illustration of a major part of an image formation processing portion of an image forming apparatus according to an embodiment of the present invention.

Referring mainly to FIG. 1, the general arrangement of the image forming apparatus will be described mainly on the image forming process. FIG. 1 is a schematic illustration of a major part of an image formation processing portion of an image forming apparatus according to the first embodiment of the present invention.

The electrophotographic photosensitive member (image bearing member) in the form of a drum is rotated in the direction indicated by an arrow X is uniformly charged by the primary charger 2, and the charging surface is exposed to image information light 3 which may be a laser beam modulated in accordance with image. By doing so, the potential of the illuminated portion attenuates, so that and electrostatic latent image is formed.

The electrostatic latent image reaches the developing zone where the developing sleeve 41 (developer carrying member) of the developing device 4 is opposed to the photosensitive drum 1. Then, the toner (developer) is deposited on the drum in accordance with the electrostatic latent image, so that toner image is formed.

As this time, the developing sleeve 41 is supplied with an AC biased DC voltage (developing bias voltage). The rotational axis of the photosensitive drum 1 is parallel with the rotational axis of the developing sleeve 41, and a predetermined gap is maintained between the surfaces of them.

In this embodiment, the polarity of the charged photosensitive drum surface and a regular polarity of the toner are both negative, and the latent image is developed through a reverse development type. In this embodiment, the regular-charge toner is the toner charged to the regular charging polarity, and the reversely charged toner is the toner charged to the opposite polarity.

On the other hand, the sheet 6 (recording material) accommodated in a cassette 5 is fed out in synchronism with the toner image formation, and is fed by a feeding roller 7 and a pair of feeding rollers 8. The upper and lower surfaces of the sheet 6 is guided by guiding members which constitute a pair and which are opposed to each other (an upper guiding member 9 which is a first guiding member and a lower guiding member 10 which is a second guiding member). Thus, the sheet 6 reaches an image transfer station where a transfer charger 11 (transferring means) is opposed to the photosensitive drum 1.

By the rotation of the photosensitive drum 1, the toner image reaches the image transfer station. At this time, the sheet 6 is closely contacted to the photosensitive drum 1. An image transfer bias voltage of the polarity (+) opposite to the toner toner is applied to the sheet 6 by the transfer charger 11, so that toner image is transferred onto the sheet 6.

Thereafter, the sheet 6 is fed to an image fixing means 12, where the unfixed toner image on the sheet 6 is fixed thereon by heat and pressure. The sheet 6 is then discharged to a discharging tray 14 by a pair of discharging rollers 13. On the other hand, residual toner remaining on the surface of the photosensitive drum 1 is removed by cleaning means 15 to be prepared for the next image forming operation.

The upper guiding member 9 and the lower guiding member 10 functions to assuredly guided the sheet 6 to the transfer station, so that sheet 6 is closely contacted into the surface of the photosensitive drum 1 during the image transfer operation.

For this purpose, the upper guiding member 9 and the lower guiding member 10 are disposed close to the surface of the photosensitive drum 1, and particularly, the distance between the free end portion 9*s* of the upper guiding member 9 and the photosensitive drum 1 is 2.5 mm where they are closest.

In this embodiment, the upper guiding member 9 and the lower guiding member 10 each comprise an electroconductive SUS metal plate 9*a*, 10*a* and an insulating member 9*b*, 10*b* of high density polyethylene resin material (insulative member), which are closely contacted to each other.

Surfaces of the insulating members 9*b*, 10*b* of the upper guiding member 9 and the lower guiding member 10 are contactable to the sheet 6, and during feeding of the sheet 6, they guided the top and bottom sides of the sheet 6.

The electroconductive metal plates 9*a*, 10*a* are supplied with a bias voltage having the same polarity as the toner (opposite from the polarity of the image transfer bias voltage) from a voltage source 16.

Figure 2:
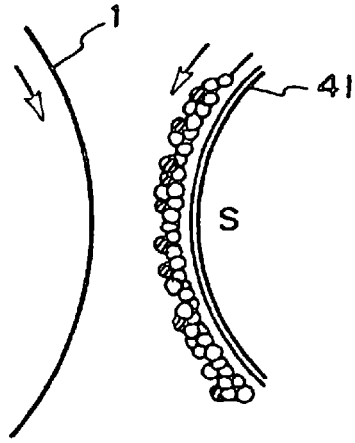
FIG. 2 PRIOR ART
FIG. 2 is a schematic view illustrating the behavior of the developer between the rotatable drum and the developer carrying member in a conventional image forming apparatus.
Figure 3:
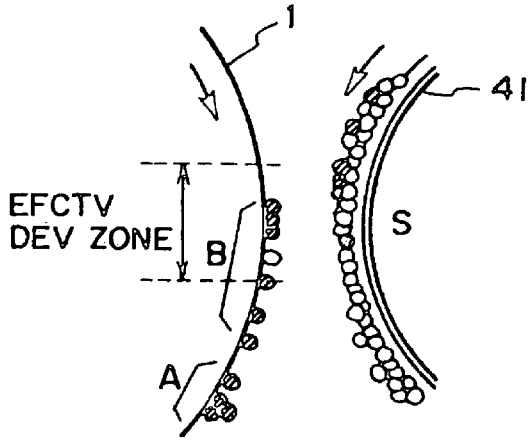
FIG. 3 PRIOR ART
FIG. 3 is a schematic view illustrating the behavior of the developer between the rotatable drum and the developer carrying member in a conventional image forming apparatus.
Figure 4:
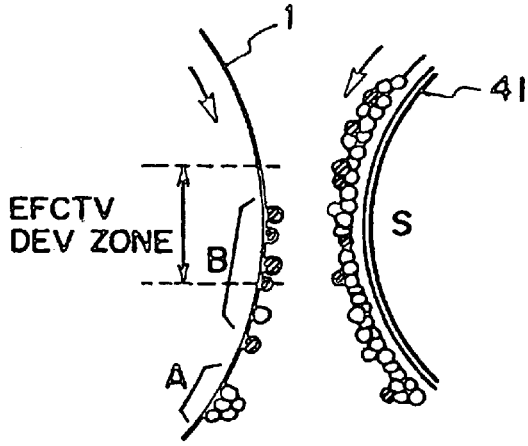
FIG. 4 PRIOR ART
FIG. 4 is a schematic view illustrating the behavior of the developer between the rotatable drum and the developer carrying member in a conventional image forming apparatus.

Referring to FIGS. 2–4, the description will be made as to the behavior of the toner between the photosensitive drum (rotatable drum) and the developing sleeve (developer carrying member) when the bias voltage application is stopped in the conventional image forming apparatus.

FIGS. 2–4 schematically illustrate the behavior of the developer (toner) between the rotatable drum and the developer carrying member in the conventional image forming apparatus.

Figure 8:
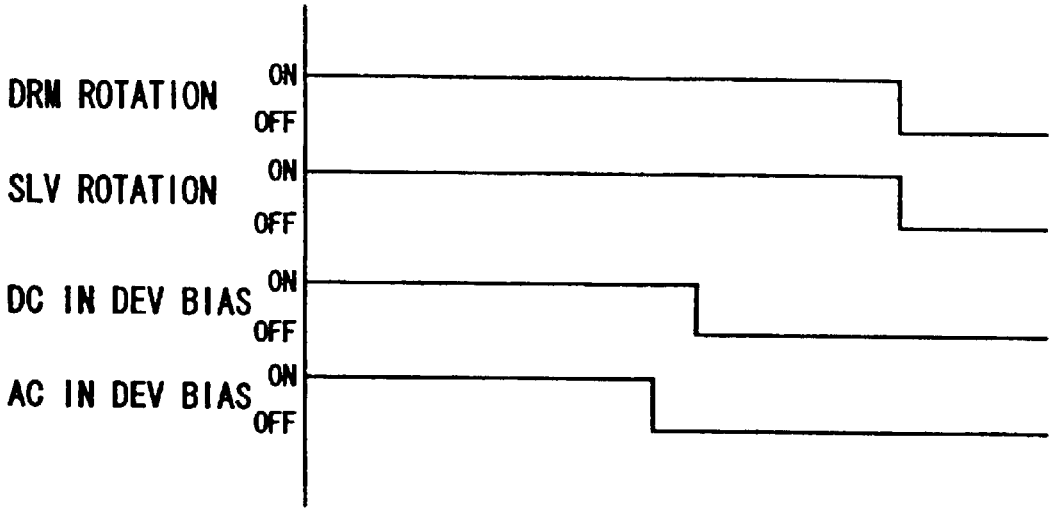
FIG. 8 PRIOR ART
FIG. 8 show a sequence of operation in the conventional image forming apparatus.

Conventionally, the developing bias voltage application is stopped while keeping the rotation of the developing sleeve S (developer carrying member), and FIGS. 2–4 illustrate the behavior of the toner at the stop. FIG. 8 shows a sequence of operation in the conventional image forming apparatus.

FIG. 2 shows a state when the developing bias voltage has not been stopped; FIGS. 3 and 4 show the states immediately after the stop of the developing bias voltage, in which FIGS. 3 and 4 are different in the position on the waveform at which the developing bias voltage is stopped.

The photosensitive drum used is OPC photosensitive member having a diameter of 30 mm, and the surface thereof is uniformly charged by a primary charger to −720V. The developing bias voltage is an AC biased DC voltage in which the DC component Vdc is −560V, and the AC component is 800V, in the peak to peak Vpp and has a frequency of 1.8 kHz. The developing sleeve S used is a sleeve which is rotated at a peripheral speed which is 1.8 times the peripheral speed of the drum. In this example, potential of the exposed portion (toner deposition portion) provided by the image exposure is −200.

The gap between the surface of the drum and the surface of the developing sleeve is 200 μm. The reverse development of a jumping development type is carried out using negative charged toner.

Although not shown, magnetic toner is applied into a thin layer coating (having a higher thickness of approx. 100 μm) on the surface of the developing sleeve by functions of a magnetic blade and a magnetic confining force provided by a stationary magnet disposed in the sleeve at a position opposed to the magnetic blade. By the rotation of the developing sleeve, the magnetic toner is carried to the effective developing zone.

The effective developing zone means a zone in which the distance between the surface of the photosensitive drum and the surface of the developing sleeve is so small that toner carried on the developing sleeve is able to transfer to the surface of the photosensitive drum.

When the image formation (development) operation is stopped, the primary charger is kept actuated in the duration in which the AC bias voltage is applied to the developing sleeve (until the developing sleeve potential becomes 0) after the start of the rotation of the developing sleeve (although the image exposure is not performed), such that portion of the surface of the photosensitive drum which is going to passes through the developing station is electrically charged. By doing so, the regular-charge toner is not deposited on the photosensitive drum even if the toner oscillates.

FIG. 2 shows the state before the developing bias voltage application is stopped, as described hereinbefore. Both of the photosensitive drum and the developing sleeve S are rotated with the developing bias applied.

In this Figure, the toner particles having the negative charge which is the regular charging are indicated by "o", and the so-called reversely charged toner having the positive charge which is the opposite is indicated by "o" with hatching lines.

In the effective developing zone, the toner reciprocations following the changes of the electric field between the drum and the developing sleeve and a frequency equivalent to 1800 Hz. After the development, the toner is transferred onto the drum corresponding to the contrast potential which is a difference between Vdc and the light portion potential.

Thus, when the photosensitive drum and the developing sleeve are located, and the developing bias voltage is applied, a small amount of reversely charged toner is transferred onto the photosensitive drum. Other than that, no toner transfer onto the photosensitive drum which may cause the deterioration of image quality is not observed.

FIGS. 3 and 4 to show the states immediately after the start of the developing bias voltage application, more particularly, the transient states which case the developing bias voltage application is stopped, while the photosensitive drum and the developing sleeve S are kept rotated.

Figure 5:
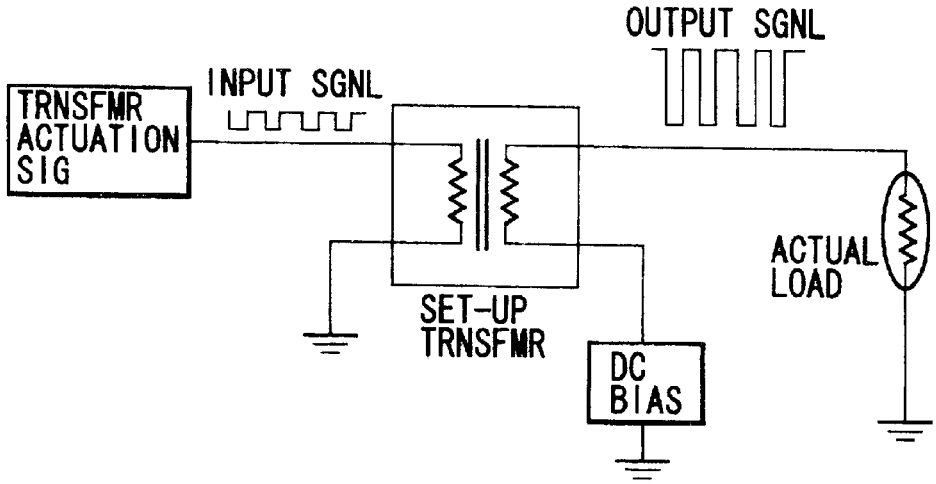
FIG. 5 is a schematic view of a circuit of a developing bias generating device.
Figure 6:
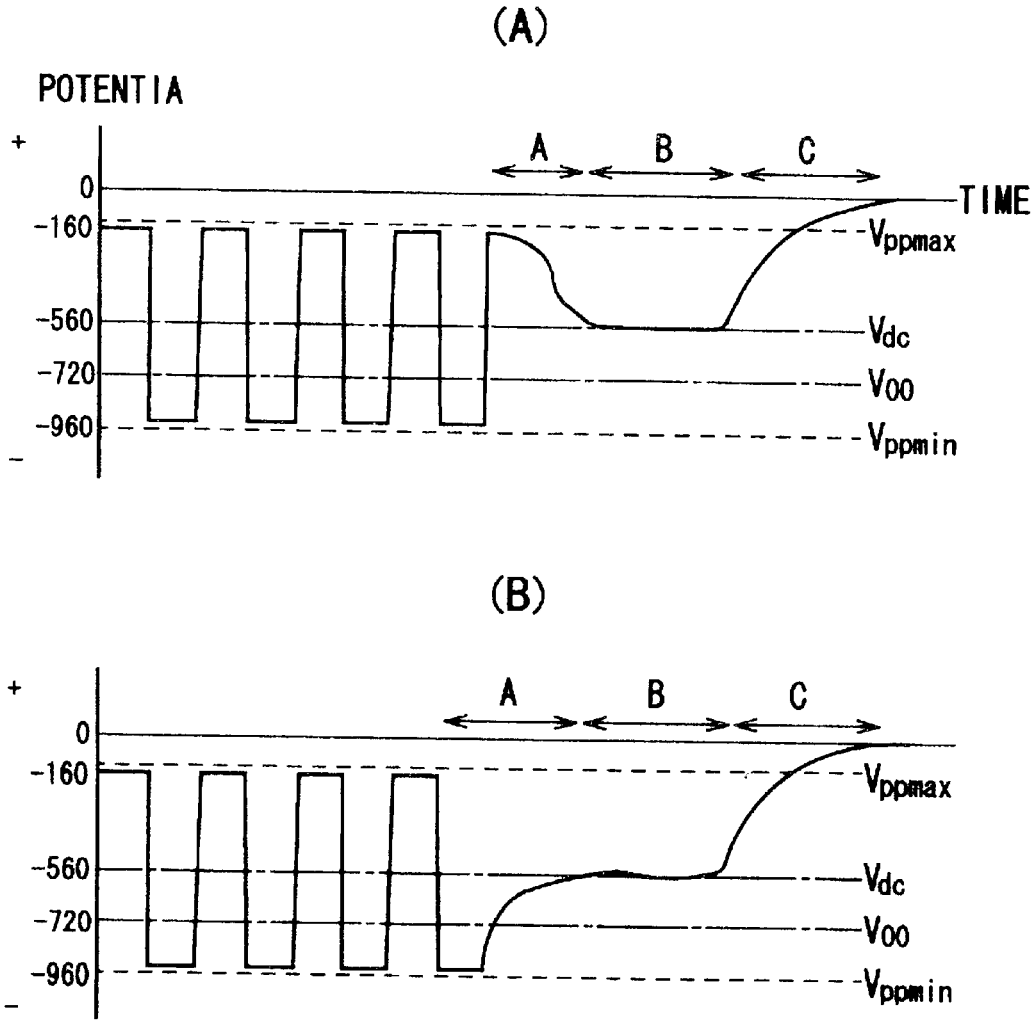
FIGS. 6(A) and 6(B) show waveforms of a developing bias voltage.

Here, referring to FIG. 5, a developing bias generating device will be described. As shown in this Figure, the developing bias voltage is provided by amplifying an input signal of 1800 Hz by a step-up transformer and is superimposed with a DC voltage Vdc. The trace of the waveform upon the stop of the developing bias voltage application is determined by the state of the time of stop of the input pulse signal and the direction of widening of the step-up transformer. Depending on the timing of the stop signal, there are inevitably two types of traces of waveform.

The two types of waveforms are shown in FIGS. 6(A) and 6(B), in which FIG. 6(A) deals with the case in which the bias waveforms at the developing position stops at Vppmax, and FIG. 6(B) deals with the case in which the bias voltage waveform stops at Vppmin.

FIG. 3 illustrates a behavior of the toner adjacent the effective dropping zone when the developing bias stops with the waveform shown in FIG. 6(A).

As shown in FIG. 6(A), when the input signal ends at the Low, the developing bias voltage level attenuates from Vppmax (−160V) to the developing bias Vdc (A region), and the voltage is temporarily maintained at Vdc (B region), and then further attenuates to OV since the drum charging operation and Vdc stops C region).

In this case, before the developing bias voltage application is stopped, the toner oscillates or reciprocate between the photosensitive drum and the developing sleeve S in a floating state, in the effective developing zone, as has been described in conjunction with FIG. 2.

When the bias voltage waveform application stops at Vppmax (−160V), a strong back-transfer electric field (electric field applying the holes to the regular charge toner in the direction of moving toward the developing sleeve) between the photosensitive drum and the developing sleeve, and therefore, only the reversely charged toner in the floating toner is selectively transferred onto the drum with the result of fog in the form of a stripe.

Since the developing sleeve S continues to rotate even in the B region, the reversely charged toner is always supplied, and therefore, the reversely charged toner continues to be deposited onto the photosensitive drum (FIG. 3).

Therefore, as described in the foregoing, the reversely charged toner is attracted by the buyers voltage applied to the free end portion of the transfer guide, with the result of contamination at the leading and trailing edges of the sheet.

This phenomenon is not very remarkable in normal cases, and therefore, quite a long time is required for the contaminating toner to accumulate, and the contamination of the sheet occurs at interval, not continuously. However, under an extreme low humidity ambient condition, if the developing operation is repeated for a long term, the toner becomes excessively charged. The excessively charged toner is firmly deposited on the surface of the developing sleeve, so that toner particles are not exchanged. Then, the proper electric charge application to the toner is obstructed. The amount of electric charge of the toner decreases, and the amount of the reversely charged toner increases. In the worst case, the contamination occurs continuously.

In the C region the charged potential of the drum and the developing bias Vdc are the same levels and attenuate to 0V, and therefore, the toner is hardly deposited on the drum.

FIG. 4 illustrates a behavior of the toner adjacent the effective developing zone when the developing bias stops with the waveform shown in FIG. 6(B).

As shown in FIG. 6(B), when the input signals ends at the High, the developing bias voltage level attenuates from Vppmin (−960V) to the developing bias Vdc (A region), and the voltage is temporarily maintained at Vdc (B region), and then further attenuates to OV since the drum charging operation and Vdc stops C region).

In this case, before the developing bias voltage application is stopped, the toner oscillates or reciprocate between the photosensitive drum and the developing sleeve S in a floating state, in the effective developing zone, as has been described in conjunction with FIG. 2.

When the bias voltage waveform stops at the Vppmax (−960V), the developing electric field (the electric field applying to the toner particles the force in the direction moving the toner having the regular charge to the photosensitive drum) between the photosensitive drum and the developing sleeve.

Therefore, the regular-charge toner floating and oscillating in the developing zone, that is, most of the toner particles are transferred onto the photosensitive drum with the result of a stripe which is similar to halftone image.

In the B region, the situation is the same as with FIG. 6(A) and FIG. 3. Since the developing sleeve continues to rotate, the reversely charged toner in the toner supplied for development is always supplied, and therefore, the reversely charged toner is continuously supplied to the drum.

Thus, the free end portion of the transfer guide is contaminated by the small amount of the reversely charged toner with the result of contamination of the image, although it is not so remarkable as in the foregoing case.

Even if the developing operation is repeated under an extreme low humidity ambient condition for a long term, quite a long time is required for the contaminating toner to accumulate, and the contamination of the sheet occurs at interval, not continuously, since the electric field force for transferring the reversely charged toner to the drum upon the stock of the bias voltage waveform is not as large as with the foregoing case.

However, the stripe of the regular-charge toner formed on the drum causes contamination of the elements dispose close to the drum due to the airflow caused by the job location. When the regular-charge toner constituting the stripe is collected by the cleaner, the toner may fall from a toner receptor sheet.

In the C region, charged potential of the drum and the developing bias Vdc are that same levels and attenuate to OV, and the toner is hardly transferred onto the photosensitive drum.

Figure 7:
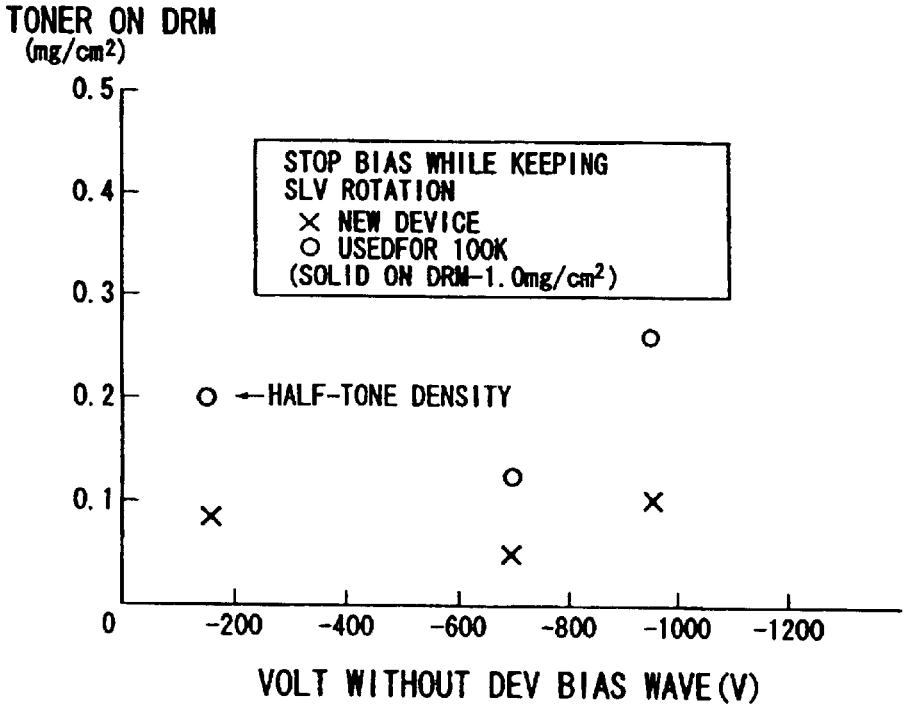
FIG. 7 shows a relation between the voltage upon stop of the waveform of the developing bias and the amount of the development toner transferred onto the drum.

FIG. 7 shows the results. In this Figure, the abscissa represents the voltage upon the stop on the developing bias, and the ordinate represents the amount of development of the right formed on the drum.

In the figure, the left side deals with the data in the case of FIG. 3, and the right side deals with the data in the case of FIG. 4. As will be understood, the case of FIG. 3 involves the more significant problem, since the contamination can be continuous.

In FIG. 7, the data of −700V in the middle is an ideal bias voltage waveform when the amplifier is connected with a pulse generator capable of forming any waveform at the start to provide the same potential as the drum potential upon the stop of the waveform (the toner transfer is least). The problems can be avoided even when the toner is quite deteriorated under the extremely low humidity ambient condition.

However, even with such a waveform, the toner is oscillating immediately after the application of the bias waveform, and therefore, there is no urging force provided by the photosensitive drum or the developing sleeve. For this reason, the low charging toner floating in the developing zone is deposited on the transfer guide and so on due to the airflow or simple (non-electrical) scattering. This may be a factor of contaminating the sheet.

In addition, such a bias voltage waveform is not practical for the commercial machines, since the required equipment is too expensive.

The description will be made as to the behavior of the toner in the embodiment of the present invention.

Figure 9:
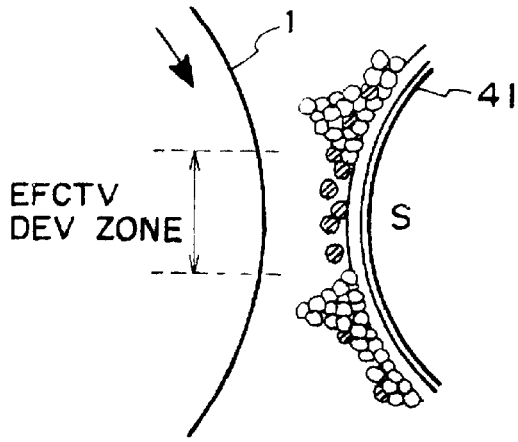
FIG. 9 is a schematic view illustrating the behavior of the developer between the rotatable drum and the developer carrying member in the image forming apparatus according to the embodiment of the present invention.

The inventors have found an interesting phenomenon. This is shown in FIG. 9.

That is, while keeping the rotation of the photosensitive drum, the rotation of the developing sleeve S is stopped, and the developing bias is applied. The toner in the effective developing zone repeats the reciprocating motion, and the toner is shifted to outside the effective developing zone and forms banks at the edges of the effective developing zone.

The reason is considered as follows. The surface of the photosensitive drum and the surface of the developing sleeve are not flat but is curved. Therefore, the gap is not uniform, and gradually increases away from the center of the effective developing zone. Because of this, the toner particles which repeats elastic collision gradually shift to larger gap portions. Since the reverse development type is used, the surface potential of the photosensitive drum is maintained at −720V, and the Vdc component of the developing sleeve is set to −560V, the regular-charge toner particles reciprocally moves, but the electric field force is oriented toward the developing sleeve side, and therefore, the surface of the drum is not developed.

For example, if the toner particles are responsive to 1.8 kHz, which means that one cyclic period is 0.55 msec, and therefore, 100 reciprocations are possible. The bias voltage application time duration of not less than approx. 50 msec is enough to shift the toner to the outside of the effective developing zone.

In addition, the following has been found. This phenomenon is particularly remarkable with respect to the toner particles sufficiently charged to the regular polarity, and such toner shifts to the outside of the effective developing zone, since only such toner particles are responsive to the alternating electric field. Because of this, only the reversely charged toner and the toner having a low level regular charge remain in the effective developing zone.

If the amount of electric charge its small, the force applied thereto by the function of the electric field is also a small, and therefore, such toner is unable to respond the alternate oscillation at the frequency of 1.8 kHz. Normally, not all the surface of the reversely charged toner has the positive charge, but there are a positive polarity portion and a negative polarity portion as a result of polarization, and macroscopically, the polarity is positive. For this reason, the amount of electric charge cannot be increased by the charge control material or externally added material having a strong power of charging the toner to the negative polarity.

The measured amount of electric charge of the toner remaining on the effective developing zone was−10 mC/kg normally, but the amount measured after the application of the developing bias after the stop of the developing sleeve S was −1.5 mC/kg (never positive) which is relatively small. The amount of electric charge of the toner in the banks outside the effective developing zone was −12 mC/kg which is relatively large. This supports the above-described consideration.

The investigation has been made as to the behavior of the toner with the use of the developing bias waveform shown in FIGS. 6(A) and 6(B).

Figure 10:
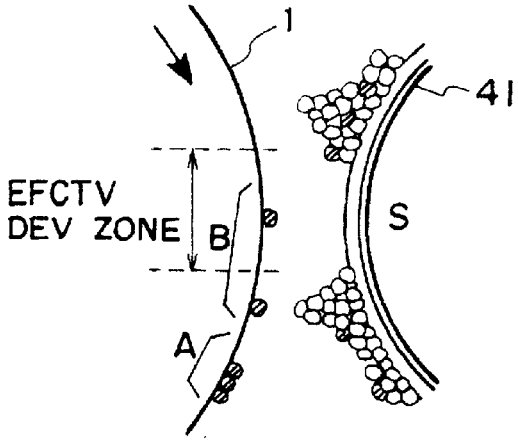
FIG. 10 is a schematic view illustrating the behavior of the developer between the rotatable drum and the developer carrying member in the image forming apparatus according to the embodiment of the present invention.

FIG. 10 illustrates a behavior toner adjacent the effective developing zone when the developing bias stops with the waveform shown in FIG. 6(A).

As shown in FIG. 6(B), when the input signal ends at the Low, the developing bias voltage level attenuates from Vppmax (−160V) to the developing bias Vdc (A region), and the voltage is temporarily maintained at Vdc (B region), and then further attenuates to OV since the drum charging operation and Vdc stops (C region).

In this case, before the developing bias voltage application stops, the toner is oscillating or reciprocating between the photosensitive drum and the developing sleeve S in a floating state by the AC in the effective developing zone, similarly to the case of FIG. 9.

When the bias voltage waveform application stops at Vppmax (−160V), a strong back-transfer electric field (electric field applying the holes to the regular charge toner in the direction of moving toward the developing sleeve) between the photosensitive drum and the developing sleeve, and therefore, only the reversely charged toner in the floating toner is selectively transferred onto the drum with the result of fog in the form of a stripe.

However, in this embodiment, is the developing sleeve S is not rotated, the amount of the transferring toner is one half the amount in the case of FIG. 3. In the B region, since the developing sleeve is not rotated, there is no toner supplied, and therefore, the reversely charged toner is not deposited onto the photosensitive drum.

Therefore, until the light stripes formed by the reversely charged toner produced upon the stop of the developing bias waveform application is accumulated, an even longer time is required, and the frequency of the contamination of the sheet is quite low.

However, the reversely charged toner is attracted to the free end portion of the transfer guide by the bias voltage applied to the transfer guide, so that reversely charged toner is deposited there with the result of contamination of the leading and trailing edges of the sheet.

However, even if a large amount of the toner is produced in a long term operation under the extreme low humidity ambient condition, the frequency of the sheet contamination is one half as compared with the conventional developing device.

Figure 11:
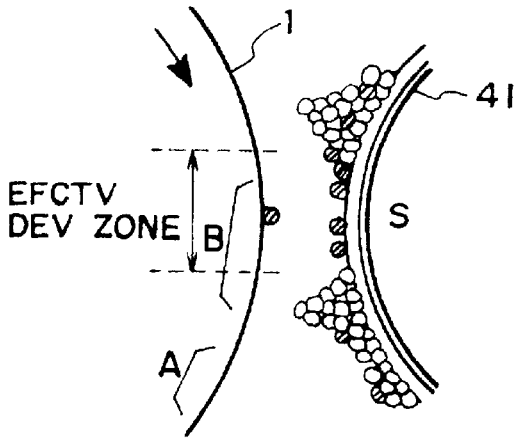
FIG. 11 is a schematic view illustrating the behavior of the developer between the rotatable drum and the developer carrying member in the image forming apparatus according to the embodiment of the present invention.

FIG. 11 illustrates a behavior of the toner adjacent the effective developing zone when the developing bias stops with the waveform shown in FIG. 6(B).

As shown in FIG. 6(B), when the input signal ends at the High, the developing bias voltage level attenuates from Vppmin (−960V) to the developing bias Vdc (A region), and the voltage is temporarily maintained at Vdc (B region), and then further attenuates to OV since the drum charging operation and Vdc stops (C region).

In this case, before the developing bias voltage application is stopped, the toner oscillates or reciprocate between the photosensitive drum and the developing sleeve S in a floating state, in the effective developing zone, as has been described in conjunction with FIG. 9.

When the bias voltage waveform stops at the Vppmax (−960V), the developing electric field (the electric field applying to the toner particles the force in the direction moving the toner having the regular charge to the photosensitive drum) between the photosensitive drum and the developing sleeve.

In this embodiment, since the toner having the regular charge is outside the effective developing zone as described hereinbefore, there is hardly any toner that has the regular charge, in the floating toner.

Therefore, even if the developing electric field exists, the toner does not transfer onto the photosensitive drum.

In addition, the floating reversely charged toner receives the force toward the surface of the developing sleeve by the developing electric field, and therefore, the toner is (closely) contacted to the surface of the developing sleeve.

In the next B region, the mirror force between the reversely charged toner and the developing sleeve is proportional to the distance squared, and therefore, the mirror force is larger than the electric field force even if the amount of electric charge is small. Thus, the amount of the reversely charged toner deposited on the photosensitive drum is very small.

Figure 12:
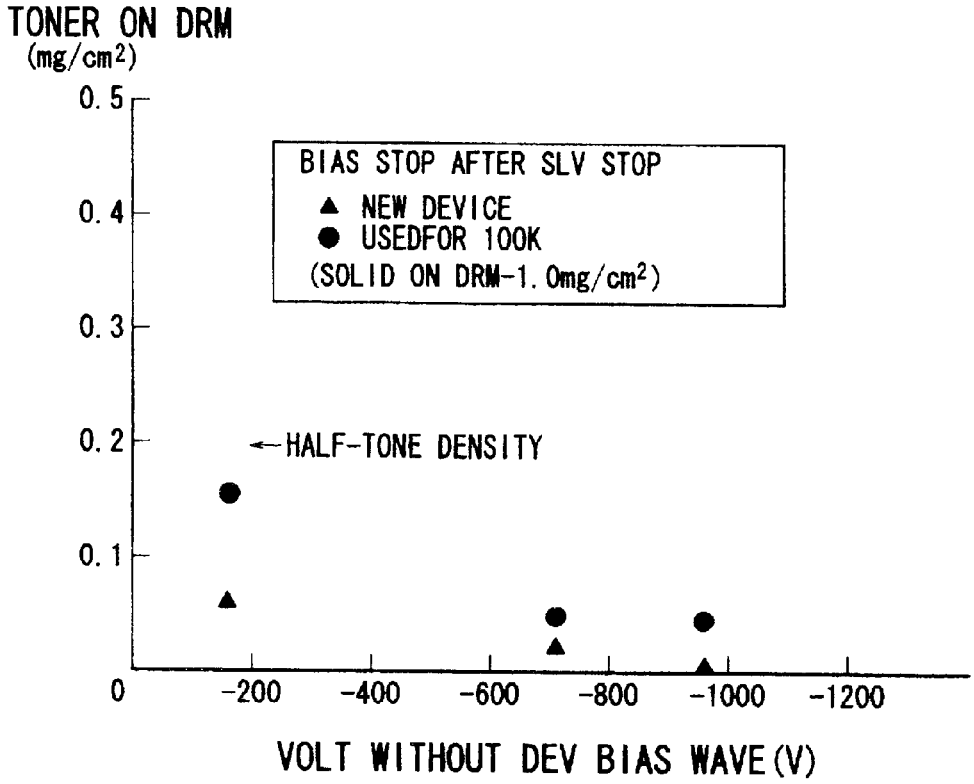
FIG. 12 shows a relation between the voltage upon the stop of the waveform of the developing bias and the amount of the toner transferred onto the drum in the image forming apparatus according to a first embodiment of the present invention.

FIG. 12 shows the results. In this Figure, the abscissa represents the voltage upon the stop of the waveform stop of the developing bias, and the ordinate represents the amount of development of the stripe formed on the drum.

The left side deals with the data described in conjunction with FIG. 10, and the righthand side deals with the data described in conjunction with FIG. 11. As compared with FIG. 5 of the prior art example, the contamination is reduced to one half with the waveform of FIG. 6(A), and the contamination is quite reduced with the waveform of FIG. 6(B).

The developing device according to this invention was incorporated in an actual machine, and the durability test was carried out with very low print ratio under the extreme low humidity ambient condition (23° C., 5%). The number of contaminating sheets and the contamination level of the transfer guide were checked after 100,000 sheets are intermittently processed. Table 1 shows the results.

| CONTAMINATIONS | | |
|---|---|---|
| Voltage at stop | −160 V | −960 V |
| Bias stop during sleeve rotation/ New app. | 15 sheets *1 N | 12 sheets *2 F |
| Bias stop during sleeve rotation/ 100,000 | >200 *1 X | 23 sheets *1 *2 N |
| Bias stop during rest of sleeve/ New app. | 0 sheet F | 0 sheet E |
| Bias stop during rest of sleeve/ 100,000 | 10 sheets *1 N | 0 sheet G |

In this Table, "E" indicates that no toner deposition is observed at the free end portions of the upper and lower guides: "G" indicates that small amount of toner is observed at the free end portions of the guides, but there will not arise any problem even if the tests continues further: "F" indicates that certain amount of toner is observed at the free end portions of the guides, but no contamination of the sheet occurred; nevertheless, the contamination of the sheet will occur in the test continues further: "N" indicates that toner deposition is observed at the entirety of the free end portions of the upper and lower guides to such an extent that toner is accumulated into a bulge. "X" indicates that situation is worst such that contamination continues from the free end portions of the upper and lower guides to positions away from the photosensitive drum. The contamination of the guides and the contamination at the leading and trailing edges are interrelated. in the The Table, *1 means contamination at the leading and trailing edges of the sheet; and *2 means toner falling from receptor sheet.

From the results of the tests, it is understood that in the conventional example in which the developing bias voltage is stopped while keeping the developing sleeve rotated, the contamination of the guide is observed irrespective of the voltage at the time when the bias waveform is stopped, and the sheets are contaminated although the number of sheets are different.

On the other hand, by stopping the application of developing bias voltage or the developing sleeve rotation, the effects are different. In the case that is stopped at −160V, the effects are recognized to a certain degree, but not complete against the contamination. With the increase of the number of operations, the amount of the reversely charged with toner increased, the sheet contamination occurs.

Figure 13:
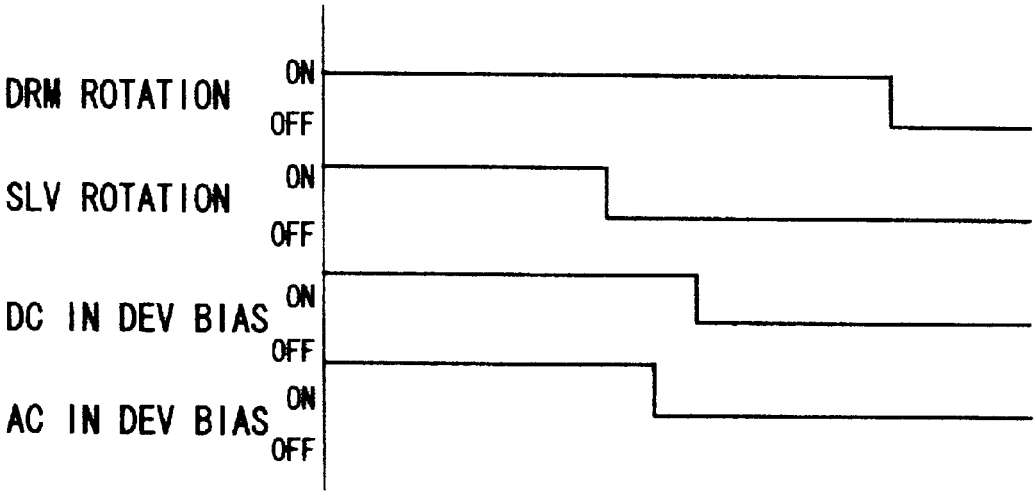
FIG. 13 shows a sequence of operation in the image forming apparatus according to the first embodiment of the present invention.

On the contrary in the case of stop at −960V, the sheet contamination or the transfer guide contamination does not occur even in the long term operation which necessarily results in increase of the reversely charged toner. The effects are very remarkable. A substantially complete interrelation with the amount of the toner on the photosensitive drum. FIG. 13 shows a sequence of operations of the drum driving, the drum charging, the developing sleeve driving and bias voltage application to the developing sleeve.

As described in the foregoing, according to this embodiment, the developing sleeve is stopped during the rotation of the photosensitive drum, and the bias voltage is kept applied for a certain period, and thereafter, the bias voltage waveform application is stopped while the developing electric field is formed. By this, the toner having the sufficient regular charge can be expelled from the effective developing zone, and the reversely charged toner is urged to the surface of the sleeve by the force produced by the developing electric field, so that mirror force between the toner and a surface of the developing sleeve is increased to prevent the position of the toner onto the photosensitive drum.

In the foregoing embodiments, the description has been made as to the reverse development type, but the present invention is applicable to the regular developing system.

However, the advantageous effects of the embodiments are remarkable in the case of the reverse development type, since the polarity of the surface potential of the photosensitive drum is the same as the polarity of the toner, and therefore, the electrical mirror force is small with the result of worse contamination of the transfer guide or like.

Second Embodiment

Figure 14:
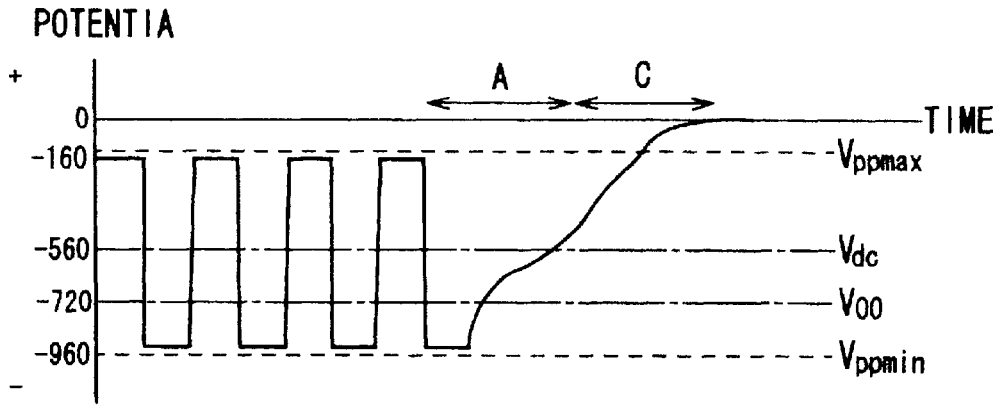
FIG. 14 shows a waveform of a developing bias in an image forming apparatus according to a second embodiment of the present invention.
Figure 15:
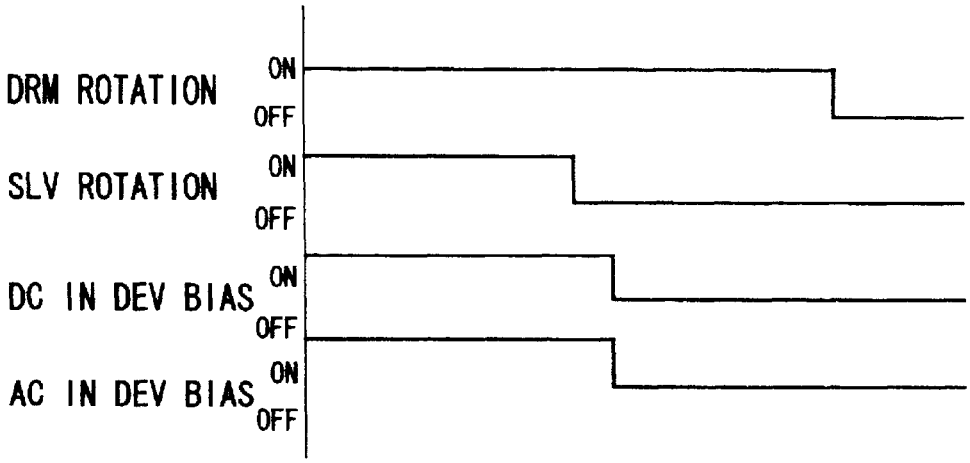
FIG. 15 shows a sequence of operation in the image forming apparatus according to the second embodiment of the present invention.

FIGS. 14 and 15 shows the apparatus according to the second embodiment of the present invention.

This embodiment is different from the first embodiment only in the stop timing of the DC bias, and the fundamental structures are the same as with the first embodiment, and therefore, the description of the common parts are omitted for simplicity.

In the first embodiment, the stop timing of the developing bias, particularly the AC bias is the feature. In this embodiment, the stop timings of the Dcmin. and the Acmin. of the developing bias voltage is the feature.

Although the detailed description is omitted in the first embodiment, the DC component is stopped after stop of the AC component as shown in FIG. 13. When the photosensitive drum and the developing sleeve are rotated in synchronism with each other, the surface potential of the photosensitive member becomes 0V upon stop of the charging of the photosensitive drum, and AC component should be removed, since otherwise the photosensitive drum is developed to a solid black with a very large amount of the toner because the developing power is very strong under the DC component alone, and the developing sleeve is rotated to supply always the toner into the developing zone. The toner is scattered to the parts around the photosensitive drum. The above-described sequence is the known as common means in the conventional electrophotographic type normal.

However, the problem has been solved by applying the developing bias with the developing sleeve at rest. This is because the toner having the having t sufficient regular charge can be expelled from the effective developing zone, as has been described in the description of the first embodiment.

By doing so, the Dcmin. and the Acmin. of the developing bias can be simultaneously stopped, so that transfer guide contamination or the like by the small amount of reversely charged toner produced during the period in which only the Vdc is applied, and the leading and trailing edge contamination of the sheet can be avoided.

Referring to FIG. 14, the description will be made in detail. FIG. 14 is a waveform graph of a developing bias in an image forming apparatus (in a transient state upon the bias voltage waveform stop).

As shown in FIG. 14 when the input signal ends at the High, the developing bias voltage level attenuates from Vppmin (−960V) to the developing bias Vdc (A region), and then, without maintaining the voltage at Vdc, the voltage attenuates to OV since the drum charging operation and Vdc stops (C region).

In this case, before the developing bias voltage application is stopped, the toner oscillates or reciprocate between the photosensitive drum and the developing sleeve S in a floating state, in the effective developing zone, as has been described in conjunction with FIG. 9.

When the bias voltage waveform stops at Vppmax (−960V), the developing electric field is formed between the photosensitive drum and the developing sleeve.

Here, in this embodiment, similarly to the first embodiment, there is hardly any toner that has the regular charge, in the floating toner, and therefore, no toner is transferred onto the photosensitive drum. In addition, the reversely charged toner floating in the developing electric field is (closely) contacted.

In this embodiment, there is no B region unlike the first embodiment, no reversely charged toner is deposited onto the drum.

The amount of the development of the reversely charged toner transferred onto the photosensitive drum upon stopping the voltage waveform, was unmeasurably small both in the case of a new a developing apparatus and the developing apparatus operated for 100,000 sheet durability test.

Then, investigations have been made by 100,000 sheet durability test, using an axial machine under the extreme low humidity ambient condition (23° C., 5%). The 100,000 sheets were processed, because 10,000 sheet test is not sufficient to check the effects. Table 2 shows the results.

| CONTAMINATIONS | | |
|---|---|---|
| Developing Bias Sequence | After DC off DC off | Simultaneous AC and DC stop |
| Guide | 11 sheets | 0 sheet |
| Contamination | F | G |

From the tests, it is understood that even when the developing sleeve is stopped during the rotation of the drum, and the developing bias is applied for a certain period of time, and thereafter, both of the DC and AC components are stopped, no sheet contamination more transfer guide contamination occurs even using the developing device after the durability tests (100,000 sheet).

FIG. 15 shows a sequence of operations for the drum driving, the drum charging, the developing sleeve driving and the developing sleeve bias application.

In this manner, when the developing sleeve is stopped during the rotation of the drum, and the developing bias is applied for a certain period of time, and thereafter, both of the DC and AC components are stopped, the toner having the sufficient regular charge can be expelled from the effective developing zone, and the reversely charged toner is urged to the sleeve surface by the force provide by the developing electric field, so that in the mirror force is increased to prevent scattering to the photosensitive drum.

Third Embodiment

Figure 16:
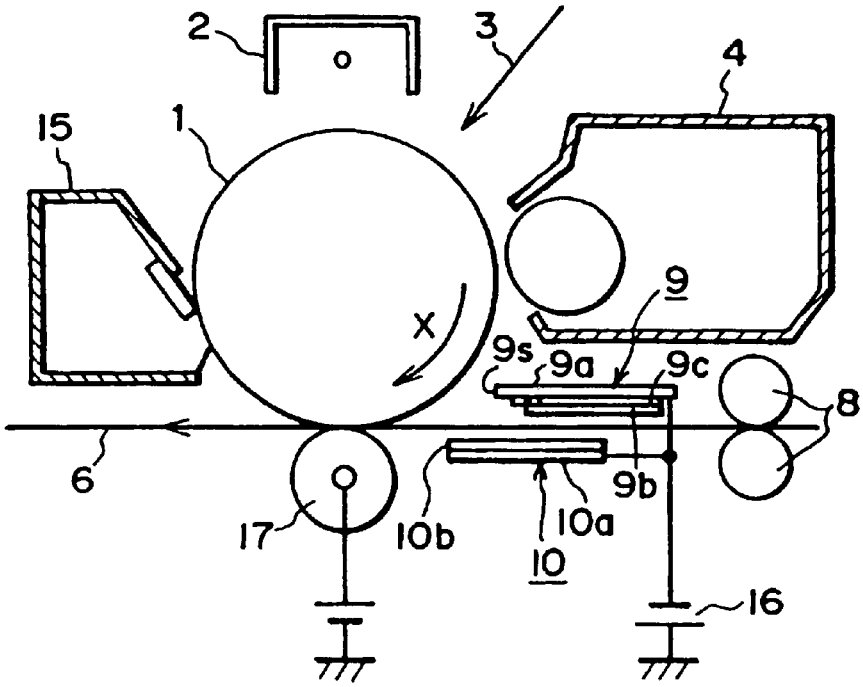
FIG. 16 is a schematic illustration of a major part of an image formation processing portion of an image forming apparatus according to a third embodiment of the present invention.
Figure 17:
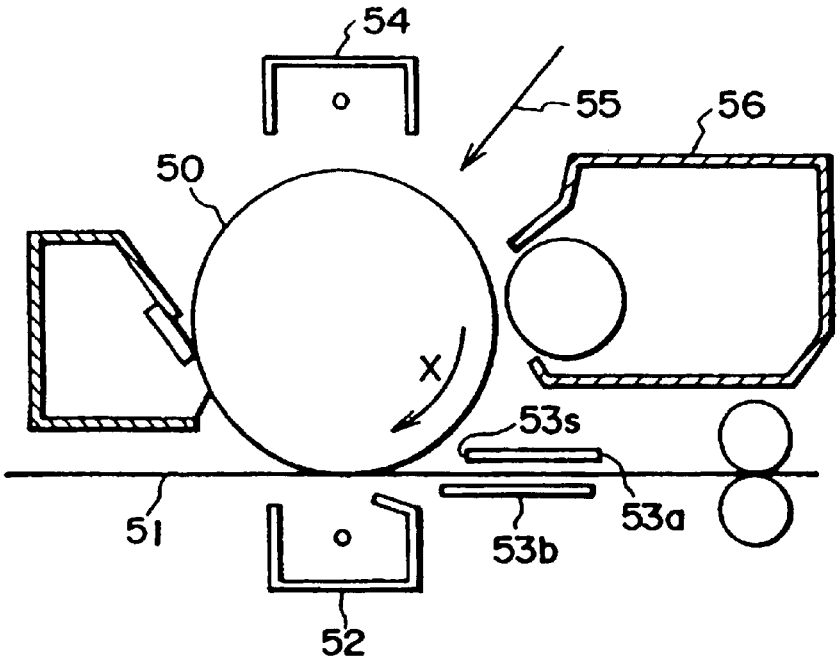
FIG. 17 PRIOR ART
FIG. 17 is a schematic illustration of an image formation process portion of a conventional image forming apparatus.

FIG. 16 shows apparatus according to a third embodiment of the present invention.

In this embodiment, the transferring means is a non-contact type transfer charger which is not directly contacted to the sheet, but the present invention is applicable to the case using a contact type transferring means. The fundamental structures are the same as in the following embodiments in other respects, and therefore, the detailed description is omitted for simplicity.

FIG. 16 is a schematic illustration of a major part of an image formation processing portion of an image forming apparatus according to the first embodiment of the present invention.

As shown in FIG. 16, this embodiment uses a contact transfer type, that is, the transferring means is a transfer roller 17.

Generally, when the use is made with the transfer roller, the transfer roller is always in contact with the photosensitive drum. There arises no problem in the period in which the sheet is passing through the transfer station. However, during a pre-rotation, doing a post-rotation and between adjacent sheets, the toner deposited on the photosensitive drum by the developing action may contaminate the transfer roller by physical and electrical forces. The toner may accumulate and contaminate the backside of the sheet.

It is known that in a system using the transfer roller, the transfer roller is supplied with an opposite polarity bias voltage (opposite from the polarity of the transfer bias) to clean the transfer roller during the pre-rotation, a sheet interval or post-rotation. By doing so, the toner accumulated on the roller by the electric field force can be transferred onto the photosensitive drum.

However, as for the reversely charged toner upon the deactuation of the developing bias voltage application, the amount of electric charge thereof is small irrespective of the polarities, and therefore, they are not easily influenced by the electric field force. For this reason, the above-described cleaning mode operation does not work.

Thus, the best means to avoid the contamination is to prevent the reversely charged toner from transferring onto the drum. It has been confirmed that by using the stop timing for the developing bias according to the first or second embodiment to prevent the reversely charged toner from transferring onto the photosensitive drum, the contamination can be avoided in the case where the transferring means is a transfer roller.

With respect to the apparatus of this embodiment, the tests similar to the first embodiments were carried out. Table 3 shows the results.

| CONTAMINATION | | |
|---|---|---|
| Voltage at stop | −160 | −960 |
| Bias stop During sleeve rotation | 155 sheets | 42 sheets |
| Bias stop After sleeve stop | 12 sheets | 0 sheet |

As will be understood from this table, when the application of the developing bias is stopped after the developing sleeve is stopped, the number of sheets having the backside contamination is smaller than with the case in which the developing bias voltage application is stopped during the rotation of the developing sleeve.

By stopping the developing bias voltage application while the developing electric field (−960V), the number of sheets having the backside contamination was zero in 100,000.

As described in the foregoing, according to this embodiment, the developing sleeve is stopped during the rotation of the photosensitive drum, and the bias voltage is kept applied for a certain period, and thereafter, the bias voltage waveform application is stopped while the developing electric field is formed. By this, the toner having the sufficient regular charge can be expelled from the effective developing zone, and the reversely charged toner is urged to the surface of the sleeve by the force produced by the developing electric field, so that mirror force between the toner and a surface of the developing sleeve is increased to prevent the position of the toner onto the photosensitive drum. In addition the transfer roller contamination can be avoided.

Similarly, by simultaneous stopping of the application of the AC bias component and the DC bias component of the developing bias voltage while the developing electric field is formed, the advantageous effects are further enhanced.

As described in the foregoing, when the developing bias is stopped, the developer having the regular charge is shifted to outside of the effective developing zone by the AC bias, and the AC bias is stopped in the state in which the regular-charge toner is being attracted to the image bearing member, and therefore, the reversely charged toner charged to the polarity opposite from that of the regular toner can be attracted to the toner carrying member. Therefore, the deterioration of the image quality attributable to the toner which is not to contribute to the information.

While the invention has been described with reference to the structures disclosed herein, it is not confined to the details set forth and this application is intended to cover such modification or changes or changes as may come within the purposes of the improvements or the scope of the following claims.

What is claimed is:

1. A developing apparatus comprising:

a toner carrying member for carrying toner to a developing zone where said developing apparatus faces an image bearing member; and bias voltage applying means for applying to said toner carrying member a developing bias voltage for developing an electrostatic image formed on the image bearing member, wherein the developing bias voltage is in the form of a DC voltage biased with an AC voltage;

wherein when a developing operation stops while the image bearing member being electrically charged rotates, rotation of said toner carrying member is stopped, and then, the AC voltage is applied to said toner carrying member for a predetermined period of time, and thereafter, the AC voltage is stopped, in a condition in which regular-charge toner is urged from said toner carrying member toward the image bearing member.

2. An apparatus according to claim 1, wherein a waveform of the AC voltage crosses with a charged potential level of the image bearing member.

3. An apparatus according to claim 2, wherein the predetermined period is not less than 50 msec.

4. An apparatus according to any one of claims 1, 2, or 3, wherein application of the DC voltage is stopped substantially simultaneously with the AC voltage.

5. An apparatus according to claim 1, wherein the developing bias voltage includes a first peak voltage for forming a substantially constant electric field for urging the regular-charge toner from said toner carrying member toward the image bearing member, and a second peak voltage for forming a substantially constant electric field for urging the regular-charge toner from the image bearing member toward said toner carrying member, wherein the AC voltage is stopped when the first peak voltage is applied.

6. An apparatus according to claim 1, wherein a charging polarity of the image bearing member is the same as a charging polarity of the regular-charge toner.

7. An apparatus according to claim 1, wherein said toner carrying member comprises a cylindrical sleeve.

8. An apparatus according to claim 7, further comprising magnetic field generating means, disposed in said toner carrying member, for generating a magnetic field for magnetically carrying the toner on said toner carrying member.

9. An apparatus according to claim 1, wherein during application of the AC voltage for the predetermined period of time and stopping of the AC voltage, a portion of the image bearing member, which is electrically charged to the same polarity as the regular-charged toner passes through the developing zone.

10. An apparatus according to claim 1, wherein application of the DC voltage is stopped after application of the AC voltage is stopped.

11. An apparatus according to claim 1, further comprising a regulating member for regulating a thickness of a layer of the toner on said toner carrying member so as to make the thickness smaller than a difference between said developing apparatus and the image bearing member.

* * * * *

UNITED STATES PATENT AND TRADEMARK OFFICE

CERTIFICATE OF CORRECTION

PATENT NO. : 7,076,182 B2
APPLICATION NO. : 10/073395
DATED : July 11, 2006
INVENTOR(S) : Keishi Osawa It is certified that error appears in the above-identified patent and that said Letters Patent is hereby corrected as shown below:

COLUMN 1:
Line 7, “and” should read --an--.

COLUMN 2:
Line 33, “has” should read --have--.
Line 48, “is” should read --are--.
Line 65, “toner” should read --toner increases--.

COLUMN 3:
Line 9, “are” should read --is--.
Line 11, “are” should read --is--.
Line 30, “contaminate” should read --contaminating--.

COLUMN 5:
Line 1, “and” should read --an--.
Line 45, “functions” should read --function--.

COLUMN 7:
Line 11, “to” should be deleted.
Line 13, “which” should read --in which--.
Line 64, “interval,” should read --intervals,--.

COLUMN 8:
Line 45, “interval,” should read --intervals,--.
Line 50, “dispose” should read --disposed--.

COLUMN 9:
Line 32, “is” should read --are--.
Line 35, “repeats” should read --repeat--.
Line 40, “moves,” should read --move,--.
Line 57, “its” should read --is--.
Line 58, “a” should be deleted.

COLUMN 11:
Line 8, “sleeve” should read --sleeve is produced.--.
Line 42, “are” should read --had been--.

UNITED STATES PATENT AND TRADEMARK OFFICE

CERTIFICATE OF CORRECTION

PATENT NO. : 7,076,182 B2
APPLICATION NO. : 10/073395
DATED : July 11, 2006
INVENTOR(S) : Keishi Osawa It is certified that error appears in the above-identified patent and that said Letters Patent is hereby corrected as shown below:

COLUMN 12:
Line 2, “continues” should read --continue--.
Line 3, “certain” should read --a certain--.
Line 8, “situation” should read --the situation--.
Line 9, “worst” should read --the worst--.
Line 59, “like.” should read --the like.--.
Line 61, “shows” should read --show--.

COLUMN 13:
Line 22, “having t” should be deleted.

COLUMN 14:
Line 16, “no sheet contamination more transfer guide” should read --no more sheet contamination by the transfer guide--.
Line 67, “they are” should read --it is--.

Signed and Sealed this

Tenth Day of April, 2007

JON W. DUDAS
*Director of the United States Patent and Trademark Office*